US008087758B2

(12) United States Patent
Okuda

(10) Patent No.: US 8,087,758 B2
(45) Date of Patent: Jan. 3, 2012

(54) LIQUID DROPLET EJECTING HEAD AND LIQUID DROPLET EJECTING APPARATUS

(75) Inventor: Masakazu Okuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 892 days.

(21) Appl. No.: 11/899,201

(22) Filed: Sep. 5, 2007

(65) Prior Publication Data

US 2008/0143793 A1 Jun. 19, 2008

(30) Foreign Application Priority Data

Dec. 18, 2006 (JP) ..... 2006-340217

(51) Int. Cl.
*B41J 2/05* (2006.01)
*B41J 2/015* (2006.01)

(52) U.S. Cl. ..... 347/65; 347/20

(58) Field of Classification Search ..... 347/40, 347/68, 70–72, 65
See application file for complete search history.

(56) References Cited

U.S. PATENT DOCUMENTS

| | | | | |
|---|---|---|---|---|
| 5,565,900 | A * | 10/1996 | Cowger et al. | 347/42 |
| 5,818,485 | A | 10/1998 | Rezanka | |
| 6,244,694 | B1 * | 6/2001 | Weber et al. | 347/65 |
| 6,286,938 | B1 * | 9/2001 | Okano et al. | 347/55 |
| 6,926,391 | B2 * | 8/2005 | Yang et al. | 347/65 |
| 7,128,404 | B2 * | 10/2006 | Kodama | 347/68 |
| 7,407,267 | B2 * | 8/2008 | Enomoto et al. | 347/49 |
| 7,470,004 | B2 | 12/2008 | Eguchi et al. | |
| 7,806,515 | B2 * | 10/2010 | Harvey et al. | 347/65 |
| 7,971,981 | B2 * | 7/2011 | Nagashima et al. | 347/89 |
| 2002/0180827 | A1 * | 12/2002 | Hirota | 347/20 |
| 2003/0150931 | A1 * | 8/2003 | Drury et al. | 239/102.1 |
| 2005/0200662 | A1 * | 9/2005 | Eguchi et al. | 347/65 |
| 2006/0214995 | A1 | 9/2006 | Hayakawa et al. | |
| 2009/0096841 | A1 | 4/2009 | Eguchi et al. | |
| 2010/0039460 | A1 * | 2/2010 | Delueg | 347/7 |

FOREIGN PATENT DOCUMENTS

| | | |
|---|---|---|
| JP | 2-212147 | 2/1989 |
| JP | 5-220953 | 2/1992 |
| JP | 06-024000 | * 1/1994 |
| JP | 7-164640 | 6/1995 |
| JP | 08-238772 | 9/1996 |
| JP | 10-157110 | 11/1996 |
| JP | 2002-234175 | 8/2002 |
| JP | 2003-276189 | 9/2003 |
| JP | 2005-246619 | 3/2004 |
| JP | 2006-088493 | 9/2004 |
| JP | 2005-225182 | 8/2005 |

* cited by examiner

*Primary Examiner* — Charlie Peng
(74) *Attorney, Agent, or Firm* — Fildes & Outland, P.C.

(57) ABSTRACT

A liquid droplet ejecting head that drives pressure generating portions disposed in pressure chambers inside ejectors to thereby pressurize liquid inside the pressure chambers and cause liquid droplets to be ejected from nozzles communicated with the pressure chambers, wherein the ejectors are connected at a plurality of places via a plurality of communicating paths to common flow paths in which forcible liquid flows are formed, is provided.

15 Claims, 7 Drawing Sheets

LIQUID DROPLET EJECTING HEAD AND LIQUID DROPLET EJECTING APPARATUS

CROSS REFERENCE TO RELATED APPLICATION

This application is based on and claims priority under 35 USC 119 from Japanese Patent Application No. 2006-340217 filed on Dec. 18, 2006.

BACKGROUND

1. Technical Field

The present invention relates to a liquid droplet ejecting head and a liquid droplet ejecting apparatus, and in particular to an inkjet recording head and an inkjet recording apparatus that eject extremely small ink droplets with piezoelectric elements.

2. Related Art

In recent years, in liquid droplet ejecting apparatus represented by inkjet printers, there has been a demand to achieve a balance between high image quality recording and high speed recording. In particular, there has been a strong demand for liquid droplet ejecting apparatus that can execute recording with high image quality even with respect to plain paper in which ink bleeding and show-through easily occur.

For performing high image quality recording with respect to plain paper, using an ink whose viscosity is high (an ink whose color material concentration is high) for ensuring high recording resolution and preventing bleeding and show-through of ink is effective.

Further, in order to realize high speed recording, it is necessary to perform high resolution recording in one pass, and a so-called matrix type head has been proposed as a liquid droplet ejecting head suited for this. The ejectors of the head are arranged two dimensionally, and each ejector is connected with a common channel as shown in FIG. 7., through which ink is supplied.

However, when a high viscosity ink and a matrix type head are combined, there has been the problem that the flow path resistance in the common flow paths becomes overly large and executing stable liquid droplet ejection becomes difficult. That is, in a matrix type head, it is difficult to ensure a large cross-sectional area in the common flow paths and it is easy for the flow path resistance to become large because the common flow paths are disposed between each of the ejectors. The head size increases when the cross-sectional area of the common flow paths is increased, which becomes a problem in terms of high densification of dots and apparatus size. In addition, when a high viscosity ink is used in a common flow path whose cross-sectional area is small, the flow path resistance in the common flow path becomes extremely large; thus, sufficient ink supply can no longer be performed with respect to each of the ejectors, and it becomes difficult to execute stable liquid droplet ejection at a high frequency.

As one measure with respect to the ink supply becoming insufficient, a method of assisting the ink supply by causing the ink inside the common flow paths to circulate has also been proposed. FIG. 7 shows ejectors of a conventional matrix type head 100 and the arrangement of a common channel 114 through which ink circulation is performed. The ejectors 120 are arranged in a two dimensional matrix array. The common channels 114 are arranged between sequences of ejectors and are connected at upstream and downstream ends to common flow path mainstreams 112. Each ejector 120 is connected to the common channel 114 via a communicating path 116 (ink feed path), and ink supply to the ejectors 120 from the common channel 114 is performed. In order to aid the common channel 114 with the supply of ink to the ejectors 120, an ink circulation flow Q is created in the direction of the arrows from an upstream ejector 120A to a downstream ejector 120B.

However, in this conventional matrix type head to which ink circulation is applied, there has been the problem that variations in back pressure resulting from the flow path resistance in the common flow paths occur. As a result, realizing high image quality recording becomes impossible.

Moreover, as another problem when a high viscosity ink is used, there is the problem that ink viscosity increases in the vicinities of the nozzles. That is, in a liquid droplet ejecting head, the ejection of ink from each of the ejectors is controlled in response to a recording signal, but in a nozzle whose use frequency is low, a phenomenon arises where the ink solvent evaporates from the nozzle opening and the ink viscosity at the portion in the vicinity of the nozzle increases. When such an ink viscosity increase occurs, this causes problems such as the ejector becoming unable to perform proper ink ejection, the droplet volume and the droplet speed becoming reduced, and non-ejection occurring.

Thus, in the present invention, it is an object to provide a liquid droplet ejecting head and a liquid droplet ejecting apparatus that address the above-described problem which arises when a matrix type liquid droplet ejecting head and a high viscosity ink are combined and can achieve a balance between high image quality recording (compatible with plain paper) and high speed recording.

SUMMARY

According to an aspect of the invention, there is provided: a liquid droplet ejecting head that drives pressure generating portions disposed in pressure chambers inside ejectors to thereby pressurize liquid inside the pressure chambers and cause liquid droplets to be ejected from nozzles communicated with the pressure chambers, wherein the ejectors are connected at a plurality of places via a plurality of communicating paths to common flow paths in which forcible liquid flows are formed.

BRIEF DESCRIPTION OF THE DRAWINGS

Exemplary embodiments of the present invention will be described in detail based on the following figures, wherein.

DETAILED DESCRIPTION

<Conventional Problem and Solution in Present Invention>

Figure 1:
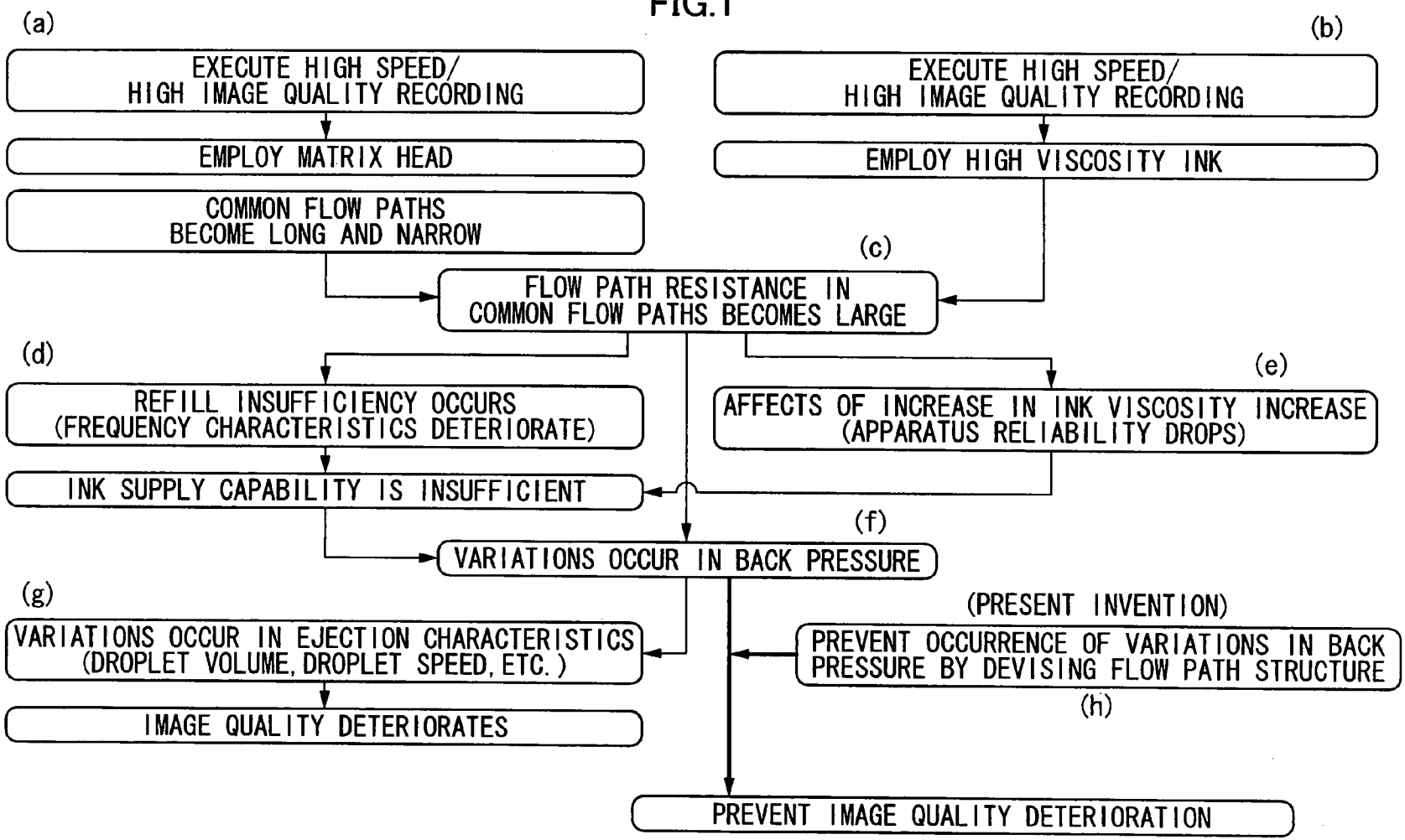
FIG. 1 is a flowchart showing the relationship between conventional problems and the present invention.

FIG. 1 is a flowchart showing conventional problems and the effects of the present invention.

By employing a two-dimensionally arranged matrix type head in order to raise speed and image quality and disposing individual ejectors in rows and columns, the density of the head (300 dpi or higher) can be increased, but the common flow paths through which the ink flows inevitably become longer (a). On the other hand, when one wishes to record (including two-sided printing) with high image quality on plain paper to which an ink bleeding and show-through countermeasure has not been administered (=such as a water-repellent treatment to the surface), it is necessary to employ a high viscosity ink (b).

The flow path resistance in the common flow paths becomes larger because of the above-described two reasons (increasing the length of the common flow paths and raising the viscosity of the ink) (c).

For this reason, refill insufficiency occurs where replenishment becomes insufficient during refill to replenish the ink that has been ejected from the ejectors, and frequency characteristics (=printing speed) deteriorate (d).

Moreover, when the resistance in the common flow paths becomes larger, the affect of the increase in the ink viscosity also increases and the reliability of the apparatus itself also deteriorates (e).

In order to solve the above-described problem of refill insufficiency and the problem of the increase in the ink viscosity, it is necessary to cause the ink inside the common flow paths to circulate, but what becomes a problem here is that when ink circulation is performed in common flow paths whose flow path resistance is large, the variations in the back pressure of the ejectors at the upstream side and the downstream side of the common flow paths are large (f), whereby ejection characteristics such as the volume of the liquid droplets and the ejection speed of the liquid droplets vary per ejector.

Thus, the present invention devises a flow path structure to connect the ejectors to plural places of the common flow paths by plurally disposed communicating paths to thereby enable the occurrence of variations in the back pressure of the ejectors to be prevented (h) and image quality deterioration to be prevented.

First Embodiment

Figure 2B:
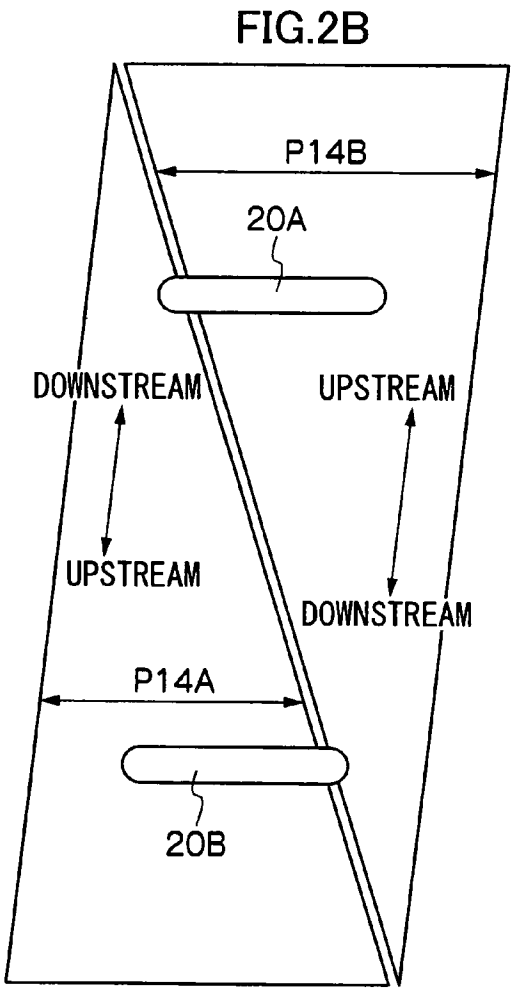
FIGS. 2A and 2B are diagrams showing a liquid droplet ejecting head relating to a first exemplary embodiment of the present invention.
Figure 2A:
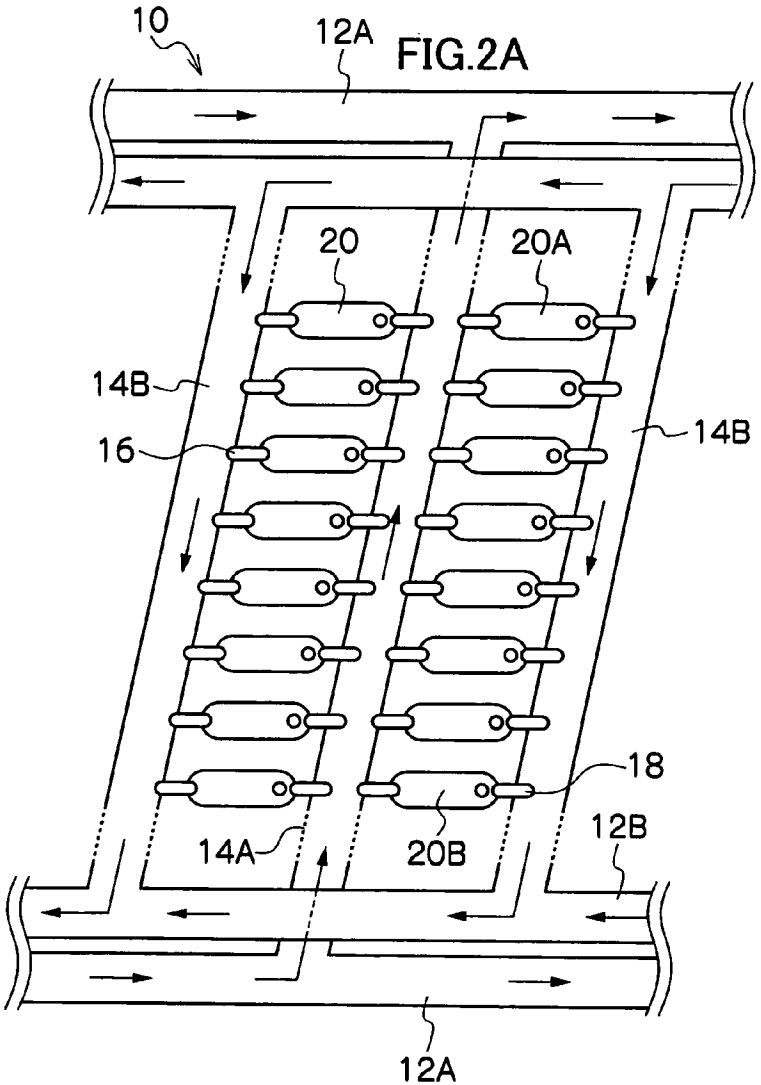

In FIGS. 2A and 2B, there is shown a liquid droplet ejecting head 10 relating to a first exemplary embodiment of the present invention.

As shown in FIGS. 2A and 2B, ejectors 20 are two-dimensionally arrayed in a matrix in the liquid droplet ejecting head 10, common flow paths 14A and 14B whose liquid flow directions are different are alternately disposed between columns of the ejectors 20, and ink is supplied to the common flow paths 14A and 14B from common flow path mainstreams 12A and 12B.

The common flow path mainstreams 12A and 12B supply ink to the common flow paths 14A and 14B, which supply ink to each of the ejectors 20 via first communicating paths 16 and second communicating paths 18. Thus, back pressure resulting from the liquid flows in opposite directions acts on the ejectors 20 from the first communicating paths 16 and the second communicating paths 18.

That is, the present embodiment is characterized in that the directions of the ink circulation flows are mutually different between the common flow paths 14A and 14B that are adjacent, and the two communicating paths 16 and 18 are disposed in each of the ejectors 20 so that the two communicating paths 16 and 18 are connected to the separate common flow paths 14A and 14B (common flow paths whose ink circulation flows are in opposite directions).

In addition, the common flow path mainstreams 12A and 12B are also respectively independent per circulation flow such that the directions of the ink circulation flows are opposite between the common flow paths 14A and 14B that are adjacent, and in FIG. 2A, one each of the common flow path mainstreams 12A and 12B is disposed for each of the common flow paths 14A and 14B.

By employing the above-described flow path structure, it becomes possible to make the acting back pressure substantially constant with respect to all of the ejectors 20 that are two-dimensionally arrayed.

Turning now to an ejector 20A, for example, the first communicating path 16 is connected to the downstream side (where back pressure is low) of the common flow path 14A, and the second communicating path 18 is connected to the upstream side (where back pressure is high) of the common flow path 14B. Consequently, the back pressure acting on a pressure chamber of the ejector 20A becomes equal to the average of pressures at two points (the place where the first communicating path 16 and the common flow path 14A are interconnected and the place where the second communicating path 18 and the common flow path 14B are interconnected).

Further, turning now to an ejector 20B, the first communicating path 16 is connected to the upstream side (where back pressure is high) of the common flow path 14A, and the second communicating path 18 is connected to the downstream side (where back pressure is low) of the common flow path 14B. Consequently, the back pressure acting on the pressure chamber of the ejector 20B becomes equal to the average of pressures at two points (the place where the first communicating path 16 and the common flow path 14A are interconnected and the place where the second communicating path 18 and the common flow path 14B are interconnected), and this becomes equal to the back pressure acting on the pressure chamber of the ejector 20A.

That is, as shown in FIG. 2B, the back pressures acting on the pressure chambers of the ejectors 20A and 20B are equal to the average of pressures P14A and P14B of the common flow paths 14A and 14B, and as long as one of the common flow paths 14A and 14B has a high pressure on the upstream side, the other will have a low pressure on the downstream side, so the back pressure acting on the ejectors 20, which is equal to the average of both of the pressures, becomes a constant value regardless of the places where the ejectors 20 are connected.

In this manner, by forming the ink circulation flows in opposite directions in the adjacent common flow paths 14 and connecting each of the ejectors 20 to both of the common flow paths 14, it becomes possible to make the back pressure acting on each of the ejectors 20 substantially constant.

<Ink Flows Inside Ejectors>

Figure 3:
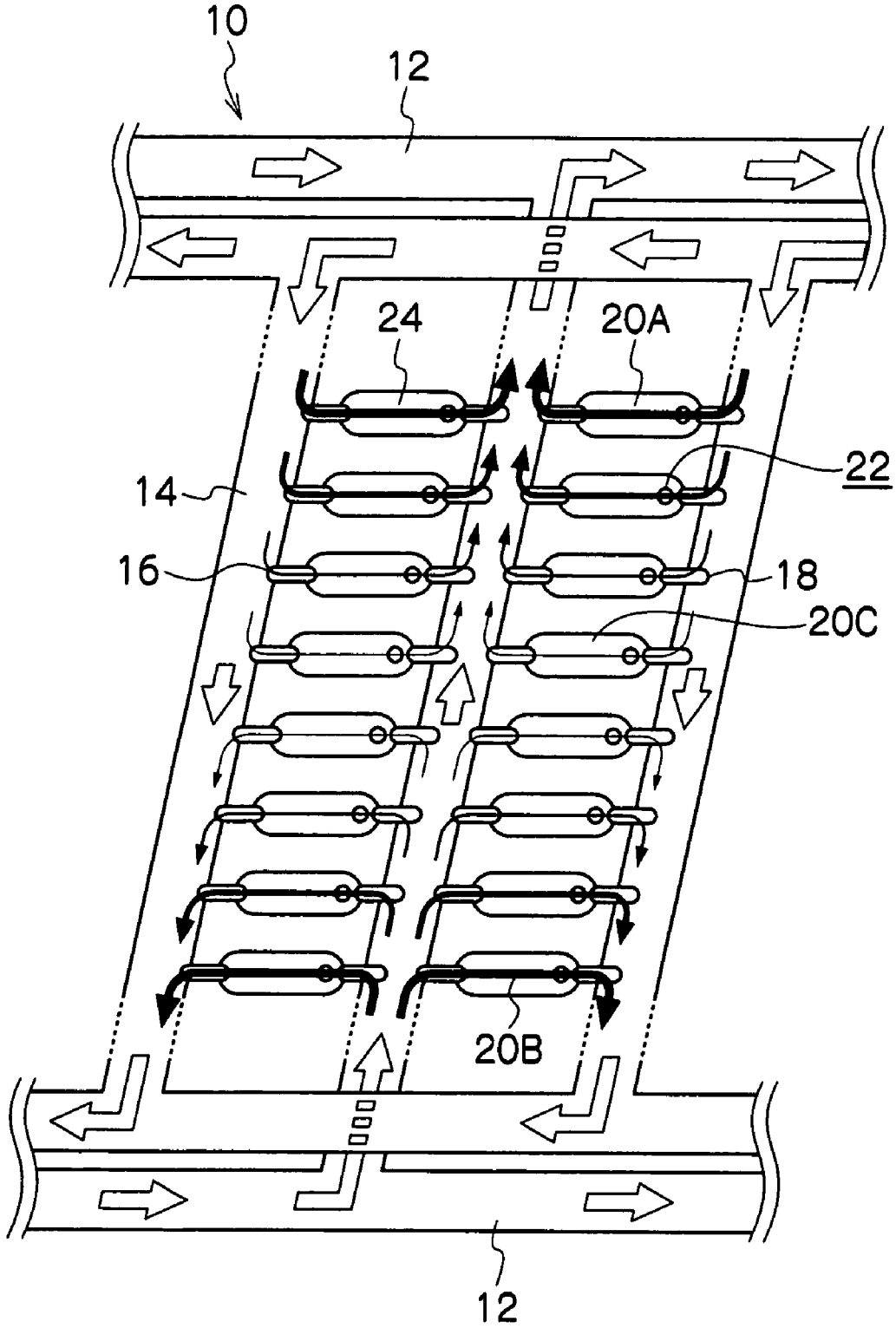
FIG. 3 is a diagram showing liquid flows in the liquid droplet ejecting head relating to the first exemplary embodiment of the present invention.

In FIG. 3, there are shown ink flows that occur inside the ejectors 20 of the liquid droplet ejecting head 10 relating to the first exemplary embodiment of the present invention.

As shown in FIG. 3, when the pressure chambers 24 of the ejectors 20 are connected to plural places of the common flow paths 14 by the plural communicating paths 16 and 18, ink flows (indicated by black arrows in the drawing) occur inside the ejectors 20 due to pressure differences at the connected places.

By effectively utilizing these ink flows to cause the ink inside the pressure chambers 24 to always circulate, the ink can be refreshed, and it becomes possible to prevent the accumulation of increased-viscosity ink and changes (such as sedimentation of color material) in the nature of the ink inside the pressure chambers 24. That is, there is the potential for ink whose solvent content has dropped to increase in viscosity due to ink staying inside the pressure chambers 24 for a long time or for the color material that had been dispersed within the ink to cause a change in the nature such as aggregation or sedimentation, but this situation can be avoided by causing the ink inside the pressure chambers 24 to always flow.

In the present exemplary embodiment, by disposing one of the two communicating paths 16 and 18 disposed in the pressure chambers 24 in the vicinity of the rear end of each of the pressure chambers 24 and disposing the other in the front end (=vicinities of nozzles 22) of each of the pressure chambers 24, ink circulation inside the pressure chambers 24 can be efficiently performed and it becomes easier to obtain the above-described effect.

It will be noted that, as indicated by the fatness of the black arrows in FIG. 3, the flow rate of the ink flow occurring inside each of the ejectors 20 will differ depending on the position where each of the ejectors 20 is connected to the common flow paths 14. That is, in the ejector 20A that is connected in the vicinity of the upstream side and the vicinity of the downstream side of the common flow paths 14, there is a large pressure difference between the places where it is connected to the common flow paths 14 (both ends of the ejector 20A=between the communicating paths), so a large flow rate occurs inside the ejector 20A.

On the other hand, in an ejector 20C that is connected in the vicinity of the centers of the common flow paths 14, the pressure difference between the places where it is connected to the common flow paths 14 (both ends of the ejector 20C=between the communicating paths) is small, so just a slight ink flow occurs inside the ejector 20C. Consequently, in order to obtain the effect (aforementioned) resulting from the ink flow inside the ejectors 20, it is necessary to set the places where the ejectors 20 are connected to the common flow paths 14 such that a sufficient ink flow rate is obtained even in the ejectors 20 that are connected in the vicinities of the centers of the common flow paths 14.

Further, when the flow path resistance in the communicating paths 16 and 18 is excessively small, the ink flows indicated by the black arrows become dominant, and the necessary ink flows (indicated by white arrows) inside the common flow paths 14 become unable to be obtained, so it is necessary to set the flow path resistance in the communicating paths 16 and 18 to be greater than a constant amount with respect to the flow path resistance in the common flow paths 14.

Specifically, it is preferable to set the ratio (R2/R1) of a flow path resistance sum R1 of the communicating paths 16 and 18 to a flow path resistance R2 of the common flow paths 14 (portions between each of the ejectors 20) to be 10 times or greater and more preferably 1000 times or greater.

<Interconnecting Ejectors and Common Flow Paths>

Figure 4A:
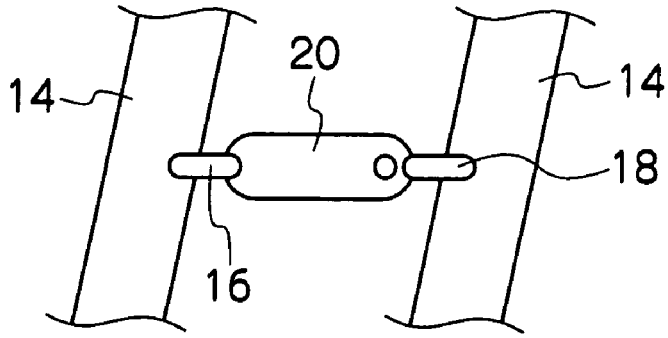
FIG. 4A is a diagram showing a connecting portion of the liquid droplet ejecting head relating to the first exemplary embodiment of the present invention.
Figure 4B:
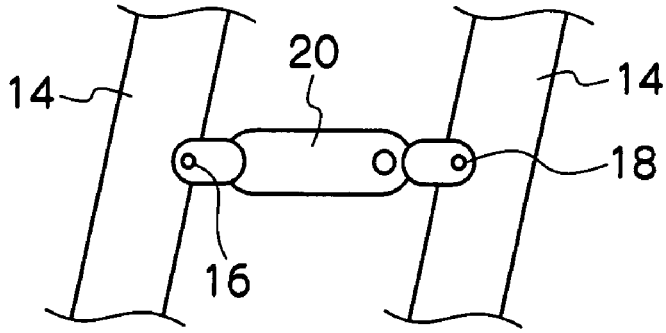
FIG. 4B is a diagram showing a connecting portion of a liquid droplet ejecting head relating to a second exemplary embodiment of the present invention.
Figure 4C:
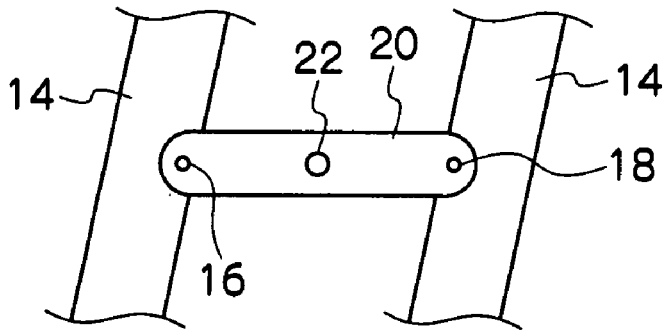
FIG. 4C is a diagram showing a connecting portion of a liquid droplet ejecting head relating to a third exemplary embodiment of the present invention.

In FIGS. 4A to 4C, there are shown methods of connecting the ejectors 20 and the common flow paths 14 relating to the present invention.

In the first exemplary embodiment (FIG. 2A, FIG. 2B and FIG. 3), the ejectors 20 (the pressure chambers 24) and the common flow paths 14 are interconnected via the communicating paths 16 and 18 that are groove-shaped (FIG. 4A), but the shape and form of the communicating paths 16 and 18 are not limited to this.

For example, the communicating paths 16 and 18 may also be disposed as holes that are disposed in members separate from the ejectors 20 as in a second exemplary embodiment shown in FIG. 4B, or the ejectors 20 and the common flow paths 14 may be interconnected via hole-shaped communicating paths 16 and 18 that are disposed in both end portions of the ejectors 20 as in a third exemplary embodiment shown in FIG. 4C. That is, it is possible for the communicating paths 16 and 18 to employ any shape and form as long as they have a flow path shape with which the desired flow path resistance R1 can be obtained.

In the third exemplary embodiment shown in FIG. 4C, the pressure chambers 24 of the ejectors 20 are disposed so as to bridge the two common flow paths 14, and the pressure chambers 24 and the common flow paths 14 are interconnected via the hole-shaped communicating paths 16 and 18. By employing this structure, it becomes possible to implement the present invention with a simple head structure where the number of parts is few.

<Cross Section>

Figure 5:
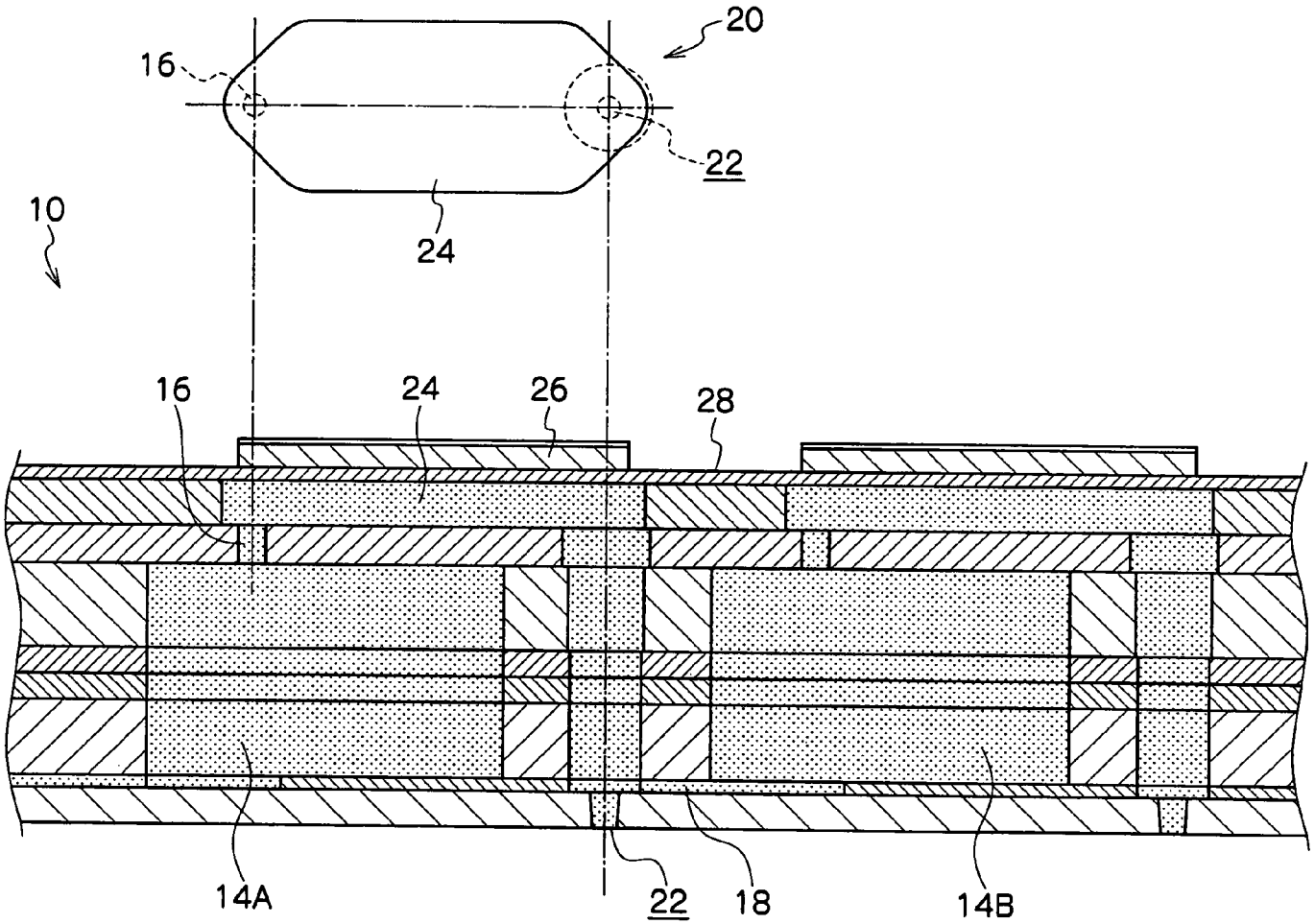
FIG. 5 is a diagram showing the cross section of a liquid droplet ejecting head relating to a fourth exemplary embodiment of the present invention.

In FIG. 5, there is shown an ejector portion that is created by laminating plural metal plates in a liquid droplet ejecting head 10 relating to a fourth exemplary embodiment of the present invention.

As shown in FIG. 5, the flow paths in the liquid droplet ejecting head 10 are formed by laminating and joining together plural plates in which holes have been punched by wet etching or the like.

A pressure plate 28 integrated with a piezoelectric element 26 is disposed on one wall surface of the pressure chamber 24, and the piezoelectric element 26 is driven by a control signal from an unillustrated controller. When the piezoelectric element 26 vibrates, the pressure plate 28 integrated therewith also vibrates and pressurizes the ink inside the pressure chamber 24.

The pressurized ink is ejected as ink droplets from the nozzle 22. The ink inside the pressure chamber 24 that is consumed thereby is replenished from the common flow paths 14 via the communicating paths 16 and 18.

The pressure chamber 24 is connected to the common flow paths 14 via the communicating path 16 and the communicating path 18 as in FIG. 5. In the present exemplary embodiment, the communicating paths 16 are formed as holes and the communicating paths 18 are formed as grooves, but as mentioned earlier the shapes of the communicating paths 16 and 18 are not limited to these holes or grooves as long as the desired flow path resistance R1 can be ensured.

At this time, the common flow path 14A and the common flow path 14B are connected to the common flow path mainstreams 12 such that the ink flows in opposite directions (see FIGS. 2A and 2B), and an ink circulation flow is formed by a pathway such as the following, for example: common flow path 14A→communicating path 16→pressure chamber 24→communicating path 18→common flow path 14B.

Thus, by forming ink circulation flows in opposite directions in the common flow paths 14 that are adjacent and connecting each of the ejectors 20 to both of the common flow paths 14 while maintaining the refill characteristics of the ejectors 20, it becomes possible to make the back pressure acting on each of the ejectors 20 substantially constant.

Other Embodiments

Figure 6:
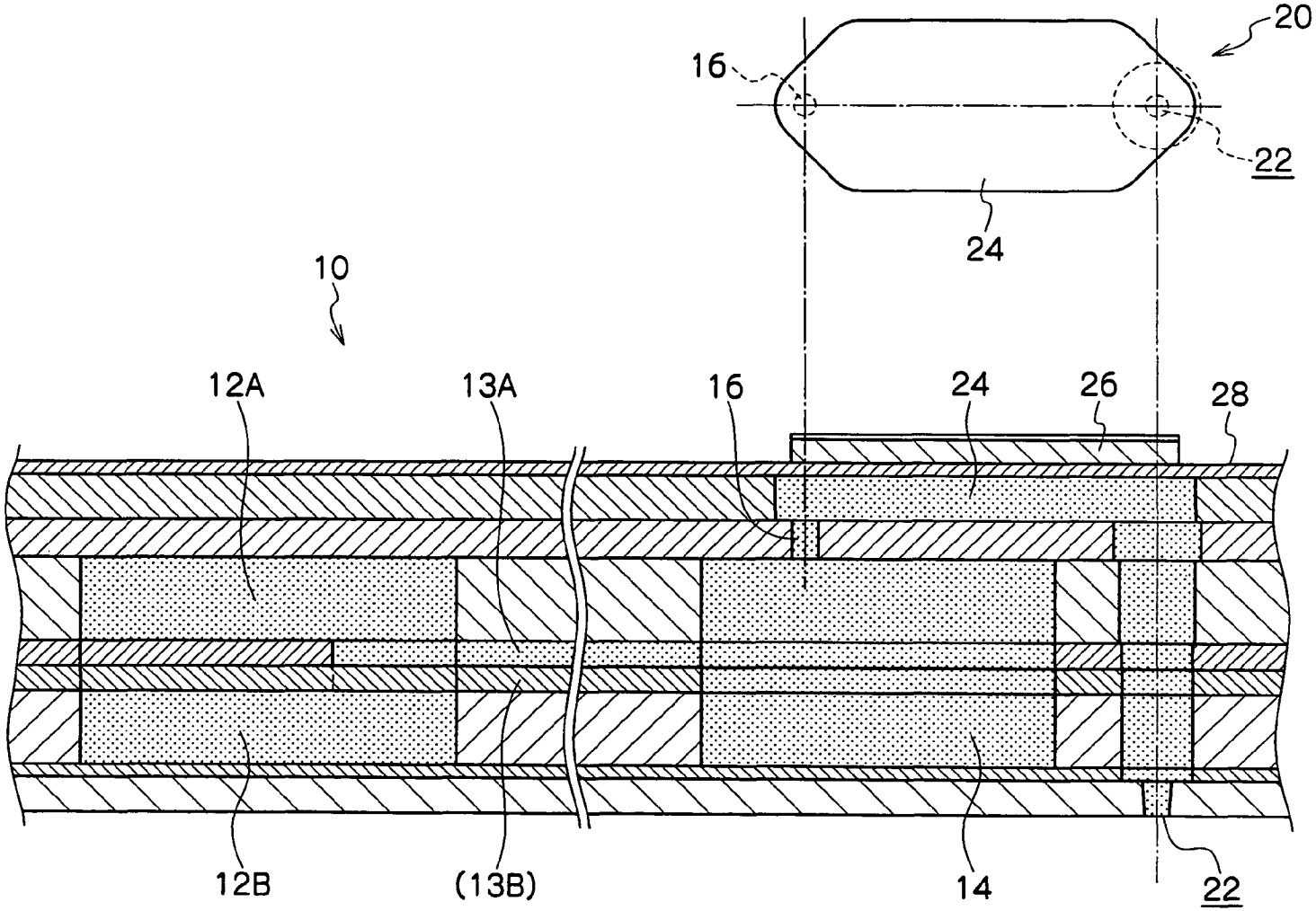
FIG. 6 is a diagram showing the cross section of a liquid droplet ejecting head relating to a fifth exemplary embodiment of the present invention.
Figure 7:
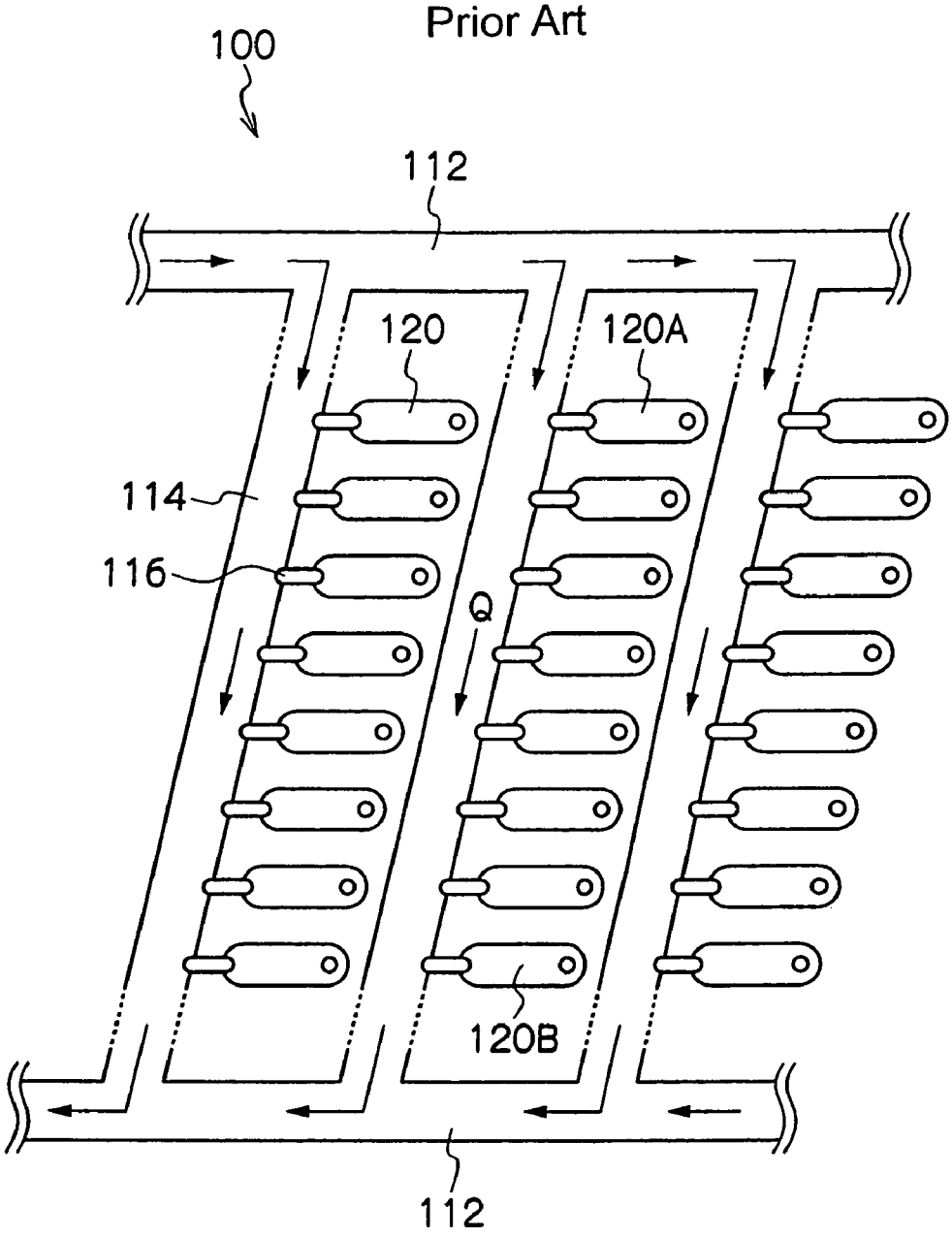
FIG.7 Prior Art
FIG. 7 is a diagram showing a conventional liquid droplet ejecting head.

In FIG. 6, there is shown a connected state of common flow paths and common flow path mainstreams in an ejector portion that is created by laminating plural metal plates in a liquid droplet ejecting head relating to a fifth exemplary embodiment of the present invention.

As shown in FIG. 6, the flow path in the liquid droplet ejecting head 10 is the same as that of the fourth exemplary embodiment in that it is formed by laminating and joining together plural plates in which holes have been punched by wet etching or the like.

In the present exemplary embodiment, the common flow path mainstream 12A and the common flow path mainstream 12B whose flow directions are mutually different are formed inside the liquid droplet ejecting head 10 as a two-story structure and are connected via a common flow path communicating path 13A or a common flow path communicating path 13B to the common flow paths 14 disposed between the ejectors 20.

By employing the above-described structure, it becomes possible to arbitrarily set the ink flow directions inside the common flow paths 14 by selecting between the common flow path communicating paths 13A and 13B, and it becomes possible to form the ink circulation flow as shown in FIGS. 2A and 2B. With this structure, further high densification can be easily realized because the projection area of the common flow path communicating paths 13A and 13B seen from the liquid droplet ejection direction (nozzle direction) can be kept to an amount corresponding to one common flow path communicating path.

It will be noted that the ink circulation flows inside the liquid droplet ejecting head 10 are generated by a pump (not shown) or the like disposed outside the liquid droplet ejecting head 10. Further, the ink circulation flows may have a planar arrangement where they are arranged in the left-right direction in the drawing without having a two-story structure as in FIG. 6.

CONCLUSION

As described above, the liquid droplet ejecting head relating to the present invention has a structure where ejectors are connected at plural places via plurally disposed communicating paths to common flow paths in which forcible liquid flows of liquid are formed, whereby the liquid droplet ejecting head can prevent the prevent the occurrence of variations in back pressure acting on the ejectors and can prevent image quality deterioration.

Exemplary embodiments of the present invention have been described above, but the present invention is in no way limited to the above-described exemplary embodiments and may of course be implemented in various modes in a range that does not depart from the gist of the present invention.

Further, the present invention can be applied not only to a liquid droplet ejecting head that uses an electromechanical converter (specifically, piezo actuators and electrostatic actuators) but also to a liquid droplet ejecting head that uses other ejection principles such as a thermal method.

Moreover, the applied field of the present invention is not limited to inkjet printers, and it is also possible to apply the present invention to all types of liquid droplet ejecting apparatus including industrial use liquid droplet ejecting apparatus such as those used in color filter manufacturing and semiconductor manufacturing and various types of film forming apparatus. Particularly in industrial purposes, there are many needs to eject liquids of high viscosity, so it is possible to effectively utilize the present invention.

It is an object of the present invention to provide a liquid droplet ejecting head and a liquid droplet ejecting apparatus where, in a matrix type liquid droplet ejecting head, there are few variations in back pressure occurring in each ejector.

A liquid droplet ejecting head of a first aspect is characterized in that it is a liquid droplet ejecting head that drives pressure generating portions disposed in pressure chambers inside ejectors to thereby pressurize liquid inside the pressure chambers and cause liquid droplets to be ejected from nozzles communicated with the pressure chambers, wherein the ejectors are connected at a plurality of places via a plurality of communicating paths to common flow paths in which forcible liquid flows are formed.

The invention of this configuration has a configuration where the plural communicating paths are disposed in the ejectors and the ejectors are connected to plural points of the common flow paths via these communicating paths. The back pressure acting on the ejectors becomes the pressure inside the common flow paths at the places where the ejectors are connected, so when the ejectors are connected to the common flow paths at plural points whose pressures are different, the average of the pressures at the connected places becomes the back pressure acting on the ejectors. Consequently, by connecting each of the ejectors to plural points of the common flow paths, the differences in back pressure between the ejectors can be reduced and the characteristics between the ejectors can be made uniform.

A liquid droplet ejecting head of a second aspect is characterized in that connection points between the communicating paths and the common flow paths are set such that average values of pressures inside the common flow paths at the plurality of places where the communicating paths and the common flow paths are interconnected become substantially the same between the plurality of ejectors disposed inside the liquid droplet ejecting head.

In the invention of this configuration, the back pressure can be made substantially equal in all of the ejectors connected to the common flow paths regardless of the positions where the ejectors are connected to the common flow paths, and it becomes possible to ensure high uniformity in the ejector characteristics.

A liquid droplet ejecting head of a third aspect is characterized in that the ejectors are two-dimensionally arranged along rows and columns, and the common flow paths are disposed per each of the rows and the columns.

In the invention of this configuration, the ejectors are two-dimensionally planarly arranged, so high resolution recording can be executed in one pass.

A liquid droplet ejecting head of a fourth aspect is characterized in that the ejectors are disposed between two of the common flow paths.

In the invention of this configuration, the communicating paths that supply liquid to the ejectors can be connected to the two common flow paths that are adjacent in a small space.

A liquid droplet ejecting head of a fifth aspect is characterized in that liquid flows in mutually opposite directions are formed in two of the common flow paths that are adjacent, and the ejectors are connected to the two adjacent common flow paths by at least two of the communicating paths.

In the invention of this configuration, the back pressure can be made substantially equal in all of the ejectors connected to the common flow paths regardless of the positions where the ejectors are connected to the common flow paths, and it becomes possible to ensure high uniformity in the ejector characteristics.

A liquid droplet ejecting head of a sixth aspect is characterized in that one of the communicating paths is disposed in an end close to an ejection surface of each of the pressure chambers, and another of the communicating paths is disposed in the other end of each of the pressure chambers.

In the invention of this configuration, the ink inside the pressure chambers is always refreshed, so it becomes possible to prevent an increase in the viscosity and changes in the nature of the ink inside the pressure chambers and to improve the reliability of the apparatus.

A liquid droplet ejecting head of a seventh aspect is characterized in that one of the communicating paths is disposed in an end close to the nozzle of each of the pressure chambers, and another of the communicating paths is disposed in the other end of each of the pressure chambers.

In the invention of this configuration, by disposing one of the communicating paths in the vicinities of the nozzles, the affects of an increase in ink viscosity resulting from volatilization of the ink solvent can be controlled, and large effects can be obtained in the improvement of apparatus reliability and image quality.

A liquid droplet ejecting head of an eighth aspect is characterized in that the ratio of the sum of the flow path resistances in the plural communicating paths to a flow path resistance in the common flow paths is set to be equal to or greater than 10 times.

In the invention of this configuration, a situation is prevented where the ink flows inside the pressure chambers resulting from the flow path resistance in the communicating paths being excessively small becomes dominant and the necessary ink can no longer be obtained inside the common flow paths.

A liquid droplet ejecting apparatus of a ninth aspect is characterized in that it is disposed with the liquid droplet ejecting head of any of the first, second, and fourth to eighth aspects.

In the invention of this configuration, differences in back pressure between the ejectors can be reduced and the characteristics between the ejectors can be made uniform, so a liquid droplet ejecting apparatus where there are no irregularities in the ejection amount can be obtained.

A liquid droplet ejecting apparatus of a tenth aspect is characterized in that the ejectors are two-dimensionally arranged along rows and columns, and the common flow paths are disposed per each of the rows and the columns.

In the invention of this configuration, the ejectors are two-dimensionally planarly arranged, so high resolution recording can be executed in one pass.

The present invention is configured as described above, so variations in back pressure arising in each ejector in a matrix type liquid droplet ejecting head can be kept small and it becomes possible to realize a liquid droplet ejecting head and a liquid droplet ejecting apparatus that can ensure high characteristic uniformity between the ejectors and is capable of high quality recording.

The foregoing descriptions of the exemplary embodiments of the present invention have been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejecting head that drives pressure generating portions disposed in pressure chambers inside ejectors to thereby pressurize liquid inside the pressure chambers and cause liquid droplets to be ejected from nozzles communicated with the pressure chambers, wherein each ejector is connected at a plurality of places via a plurality of communicating paths to common flow paths in which forcible liquid flows are formed, independent liquid flows in mutually opposite directions are respectively formed in two of the common flow paths that are adjacent, and the ejectors are connected to the two adjacent common flow paths by at least two of the communicating paths.

2. The liquid droplet ejecting head of claim 1, wherein connection points between the communicating paths and the common flow paths are set such that average values of pressures inside the common flow paths at the plurality of places where the communicating paths and the common flow paths are interconnected become substantially the same between the plurality of ejectors disposed inside the liquid droplet ejecting head.

3. The liquid droplet ejecting head of claim 1, wherein the ejectors are two-dimensionally arranged along rows and columns, and the common flow paths are disposed per each of the rows and the columns.

4. The liquid droplet ejecting head of claim 2, wherein the ejectors are two-dimensionally arranged along rows and columns, and the common flow paths are disposed per each of the rows and the columns.

5. The liquid droplet ejecting head of claim 1, wherein the ejectors are disposed between two of the common flow paths.

6. The liquid droplet ejecting head of claim 1, wherein one of the communicating paths is disposed in an end close to an ejection surface of each of the pressure chambers, and another of the communicating paths is disposed in the other end of each of the pressure chambers.

7. The liquid droplet ejecting head of claim 1, wherein one of the communicating paths is disposed in an end close to the nozzle of each of the pressure chambers, and another of the communicating paths is disposed in the other end of each of the pressure chambers.

8. The liquid droplet ejecting head of claim 1, wherein the ratio of the sum of flow path resistances in the plurality of communicating paths to a flow path resistance in the common flow paths is set to be equal to or greater than 10 times.

9. A liquid droplet ejecting apparatus disposed with a liquid droplet ejecting head that drives pressure generating portions disposed in pressure chambers inside ejectors to thereby pressurize liquid inside the pressure chambers and cause liquid droplets to be ejected from nozzles communicated with the pressure chambers, wherein each ejector is connected at a plurality of places via a plurality of communicating paths to common flow paths in which forcible liquid flows are formed, independent liquid flows in mutually opposite directions are respectively formed in two of the common flow paths that are adjacent, and the ejectors are connected to the two adjacent common flow paths by at least two of the communicating paths.

10. The liquid droplet ejecting apparatus of claim 9, wherein connection points between the communicating paths and the common flow paths are set such that average values of pressures inside the common flow paths at the plurality of places where the communicating paths and the common flow paths are interconnected become substantially the same between the plurality of ejectors disposed inside the liquid droplet ejecting head.

11. The liquid droplet ejecting apparatus of claim 9, wherein the ejectors are two-dimensionally arranged along rows and columns, and the common flow paths are disposed per each of the rows and the columns.

12. The liquid droplet ejecting apparatus of claim 9, wherein the ejectors are disposed between two of the common flow paths.

13. The liquid droplet ejecting apparatus of claim 9, wherein one of the communicating paths is disposed in an end close to an ejection surface of each of the pressure chambers, and another of the communicating paths is disposed in the other end of each of the pressure chambers.

14. The liquid droplet ejecting apparatus of claim 9, wherein one of the communicating paths is disposed in an end close to the nozzle of each of the pressure chambers, and another of the communicating paths is disposed in the other end of each of the pressure chambers.

15. The liquid droplet ejecting apparatus of claim 9, wherein the ratio of the sum of flow path resistances in the plurality of communicating paths to a flow path resistance in the common flow paths is set to be equal to or greater than 10 times.

* * * * *